United States Patent [19]

Escher et al.

[11] 4,388,173

[45] Jun. 14, 1983

[54] METHOD AND APPARATUS FOR DISTILLATION OF OIL SHALE

[75] Inventors: Gerd Escher, Gelsenkirchen-Buer; Heinz Frohnert, Bottrop; Hans-Peter Wenning, Dorsten-Rhade, all of Fed. Rep. of Germany

[73] Assignee: Veba Oel Ag, Gelsenkirchen-Buer, Fed. Rep. of Germany

[21] Appl. No.: 277,001

[22] Filed: Jun. 24, 1981

[30] Foreign Application Priority Data

Jun. 25, 1980 [DE] Fed. Rep. of Germany ..... 3023670

[51] Int. Cl.[3] ..... C10B 53/06

[52] U.S. Cl. ..... 208/11 R; 202/109; 201/31

[58] Field of Search ..... 208/11 R, 8 R; 201/16, 201/31, 32, 37; 202/99, 109, 121, 215

[56] References Cited

U.S. PATENT DOCUMENTS

| | | | |
|---|---|---|---|
| 2,414,586 | 1/1947 | Egloff | 202/109 |
| 2,434,567 | 1/1948 | Jahnig et al. | 252/417 |
| 2,942,043 | 6/1960 | Rummert | 585/635 |
| 3,475,319 | 10/1969 | MacLaren | 208/11 R |
| 3,577,338 | 5/1971 | Gifford | 201/38 |
| 3,655,518 | 4/1972 | Schmalfeld et al. | 202/108 |
| 3,887,453 | 6/1975 | Ueta et al. | 208/11 |
| 3,971,704 | 7/1976 | von Klenck et al. | 202/109 |
| 4,003,797 | 1/1977 | Cheadle et al. | 201/32 X |
| 4,066,529 | 1/1978 | Reeves | 208/11 R |
| 4,105,502 | 8/1978 | Choi | 201/12 |
| 4,118,309 | 10/1978 | Myers et al. | 208/11 R |
| 4,222,850 | 9/1980 | Matthews | 208/11 R |

*Primary Examiner*—Delbert E. Gantz
*Assistant Examiner*—Glenn A. Caldarola
*Attorney, Agent, or Firm*—Oblon, Fisher, Spivak, McClelland & Maier

[57] ABSTRACT

The condensible parts are removed from the distillation gas of oil shale, a portion of the remaining amount of gas is removed and the rest is heated, e.g., by the combustion gas of the distillation residue and used without the addition of any more materials to distill oil shale. The installation for this consists of a distillation cyclone reactor, whose gas outlets are connected to an oil separator and whose tangential feed nozzles are connected by way of a blower and a heat exchanger to the oil separator.

16 Claims, 3 Drawing Figures

METHOD AND APPARATUS FOR DISTILLATION OF OIL SHALE

BACKGROUND OF THE INVENTION

1. Field of the Invention

This invention relates to the recovery of oil from oil shale and more particularly to a distillation process for oil recovery involving treatment of ground oil shale with a hot gas in a cyclone reactor followed by separation of the oil.

2. Description of the Prior Art

Numerous methods are known for distillation (retorting) of oil shale. In these the oil shale is heated, thereby breaking down the kerogen contained in the shale so that it can be extracted in the form of gaseous and liquid hydrocarbons. Depending on the hydrogen content of the oil shale, a larger or smaller amount of the organic substance can be extracted. A certain amount always remains in the shale as residual carbon. In the interest of the most complete utilization of the energy content of the oil shale, this carbon should also be used as an energy source.

Many methods use the shaft furnace principle for distillation, for example, as described in U.S. Pat. No. 3,736,247, and German-AS No. 22 43 389. The disadvantage of this method is that fine material necessarily accumulating during size reduction cannot be utilized. In addition, complete burning off of the residual carbon is made very difficult due to the requisite size of charge materials. What is more, the oil vapor and the distillation gas are exposed for an extended time to the distillation temperature, thus causing cracking reactions which reduce the yield and the quality of oil.

The shaft furnace principle cannot be used with more finely crushed material. Other methods using fine material, e.g., U.S. Pat. No. 3,844,930, operate with solid materials as heat conductors. The circulating quantity of heat conductor, which includes an amount several times as large as the amount of shale, further increases the amount of solid material that must be handled.

The German OS's Nos. 27 28 204 and 27 28 455 teach a process of pyrolysis of carbon-containing material, including oil shale, in a cyclone-reactor using solid material heat conductors as described above. Carbon-containing material with a granular size of less than 1 mm is introduced into a cyclone reactor in a carrier gas stream at speeds of 20–76 m/sec. Before or upon entry into the cyclone, this gas stream is combined with a second gas stream containing hot solid particles which serve to heat the carbon-containing material to distillation temperature. The weight relationship of the solid material used for heating to the carbon-containing material should be between 2 and 20. After a short contact time (calculated as the average time that the carrier gas is in the cyclone) of less than ca. one second, particularly between 0.1 and 0.6 sec., the distillation gas, mixed with the carrier gas, is removed from the solid materials, i.e., heat conductor particles and distillation residue.

With this known method the distillation gases are mixed and diluted with the carrier gases, making their processing more difficult. The distillation residue leaves the cyclone mixed with the solid material heat conductors, so that when it is further processed large amounts of ballast must be carried along with it.

Thus, an oil shale recovery method using distillation is needed that allows recovery of the gas and solid portions without requiring their dilution and thereby further separation.

SUMMARY OF THE INVENTION

Accordingly, it is an object of this invention to provide a method of shale oil recovery in a cyclone reactor that does not require addition of solid particles as heat carrier.

It is a further object of this invention to provide a method of shale oil recovery that does not require addition of a carrier gas in the distillation process.

These and other objects of the invention as will hereinafter become more readily apparent have been accomplished by proving a method for the distillation of oil shale in a distillation cyclone reactor using a hot gas to heat said oil shale, comprising utilizing distillation gas as said hot gas after separation of the condensable portion of said distillation gas i.e. shale oil, removing a portion of said hot gas corresponding to the increase in the amount of gas generated by distillation, and re-heating the residual portion of said hot gas without adding solid material.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DESCRIPTION OF THE PREFERRED EMBODIMENTS

Surprisingly, it has now been found that using finely ground material as a heat conductor is not required but rather the oil shale can be heated to distillation temperatures in a short enough time to avoid cracking by a hot gas alone. The hot gas is itself obtained from the distillation gases obtained in the distillation process.

The result is a pure, undiluted distillation gas from which the condensable parts can be better removed than from a distillation gas diluted with a carrier gas and which, after separating the condensible components, due to the higher concentration of gaseous hydrocarbons, has a greater value than diluted distillation gas. In the same manner, further processing of the distillation residue is made easier due to the absence of ballast materials.

The present invention is carried out by suspending and heating the crushed and ground oil shale in a hot gas stream to distillation temperature, the hot gas stream being derived from the non-condensable portion of previously formed distillation gas and separating solids from the resulting destillation gas containing hydrocarbons in a cyclone reactor.

Figure 1:
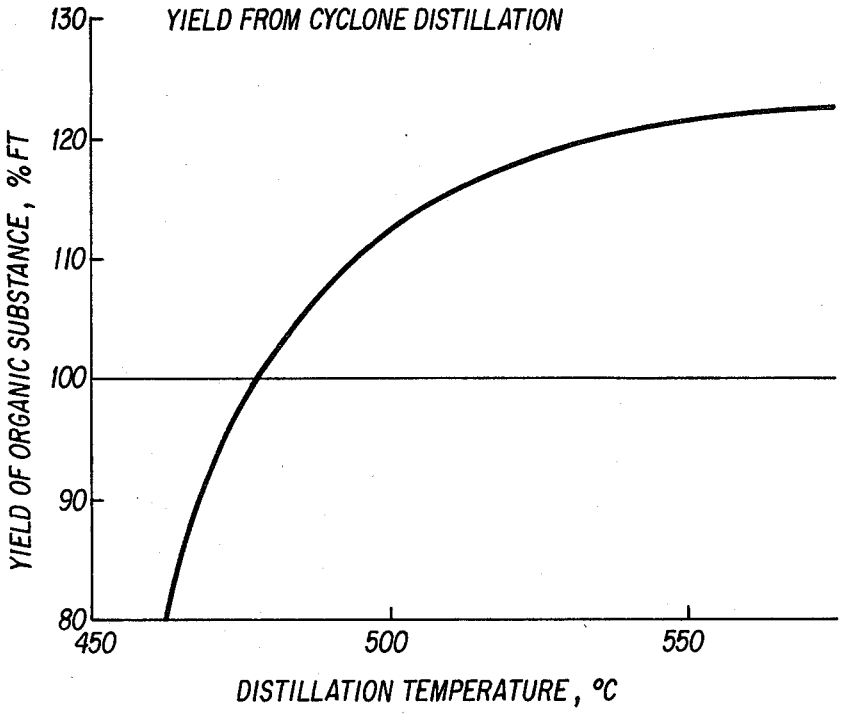
FIG. 1 shows the yields with cyclone distillation of a Schandelah oil shale at different distillation temperatures in comparison to the yield according to the Fischer assay.

The distillation temperatures are generally above 450° C. and should not exceed 650° C., otherwise yield-reducing cracking reactions cannot be avoided despite the short distillation times. The preferred temperatures are between 470° and 550° C. FIG. 1 shows the yields with cyclone distillation of a Schandelah oil shale in comparison to the yields according to the Fischer assay. The oil shale used contained 10.3% by weight of organic carbon and had the following Fischer assay yields (all percentages are by weight):

| | |
|---|---|
| Moisture (Up to 105° C.) | 1.0% |
| Distillation water | 1.9% |
| Oil | 5.4% |
| Residue | 88.3% |
| Gas and Losses | 3.4% |

With the method according to the invention, the distillation gas is preheated to temperatures from 150° to 250° C. above the distillation temperature. This overheating depends on the ratio of distillation gas volume (at S.T.P.) to oil shale weight, which normally lies between 0.8 and 1.4 $m^3$/kg, chiefly between 1.0 and 1.2 $m^3$/kg, on the temperature of the entering shale, on the residual moisture, on the carbonate decomposition of the carbonate present, and on the heat loss of the system.

To prevent the returned distillation gas from requiring excess overheating, it is advantageous to pre-dry the oil shale to a great extent and to pre-heat it to a temperature slightly below the point at which the decomposition of kerogen begins.

Another surprising aspect of the method according to the invention is that coarser material can be used than with previously known methods. Thus, oil shale with a granular size of up to 3 mm, or even 5 mm can be used. This coarser sized shale has the advantage of containing less dust, thereby making it considerably easier to process the distillation gas and to further process the distillation residue.

Figure 2:
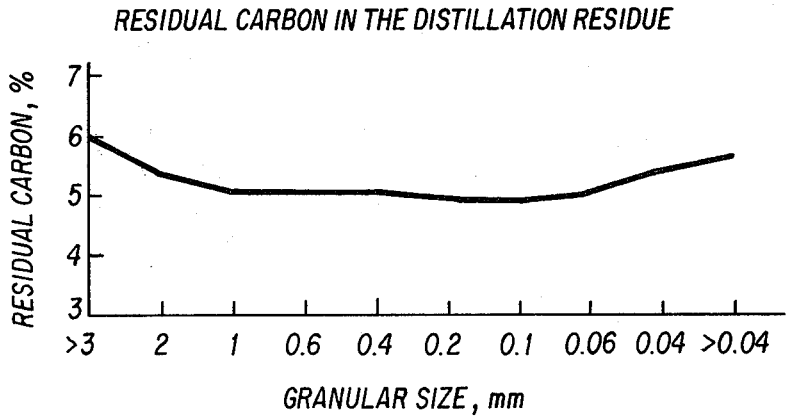
FIG. 2 shows the residual carbon content of the same oil shale after distillation in relation to its granular size.

FIG. 2 shows the residual carbon content of the above mentioned oil shale after distillation in relation to its granular size. One can see that distillation with a granular size of 2 mm is practically the same as with a granular size of 0.1 mm and that even with a granular size of 3 mm there is not more than an inconsiderable increase of the residual carbon content.

The condensible parts of the distillation gas are preferably separated out through direct cooling with cold oil, if necessary with subsequent electrostatic precipitation of the oil fog.

It has proven advantageous to remove the dust contained in the distillation gas before separating out the condensible parts, because separating the condensate from the dust is very difficult. This separation should take place at a temperature above the dew point of the condensible portion of the distillation gas. As an example, high performance cyclones can be used to separate the dust.

However, it has proven particularly advantageous to use electrostatic precipitation for separation. This is completely surprising, since it was unexpected that electrostatic precipitation of the distillation gas would be possible at the high temperatures of more than 450° C. used in the present invention. Under these conditions but without the presence of distillation vapors, the electrical field collapses in a reducing atmosphere. The distillation residue is drawn off the cyclone reactor; its carbon is advantageously burned with oxygen or with gases containing oxygen, particularly air, with the hot combustion gas being used to heat the circulating distillation gas (hot gas) or to heat the oil shale before it enters the distillation cyclone reactor.

It is advantageous if the carbon in the distillation residue is burned with gases containing oxygen in a fluid bed. The combustion conditions should be so arranged that the $SO_2$ produced by the combustion can be taken up by the dolomite and calcite possibly found in the shale residue.

The distillation yield can be improved by first degassing the distillation residue removed from the distillation cyclone reactor in a container before its carbon is burned with gases containing oxygen. Distillation gas can be passed through the distillation residue in the degassing container in order to more rapidly remove the gases that are still being generating; in such cases it is advantageous to agitate the distillation residue with a stirrer or in a rotary drum.

Figure 3:
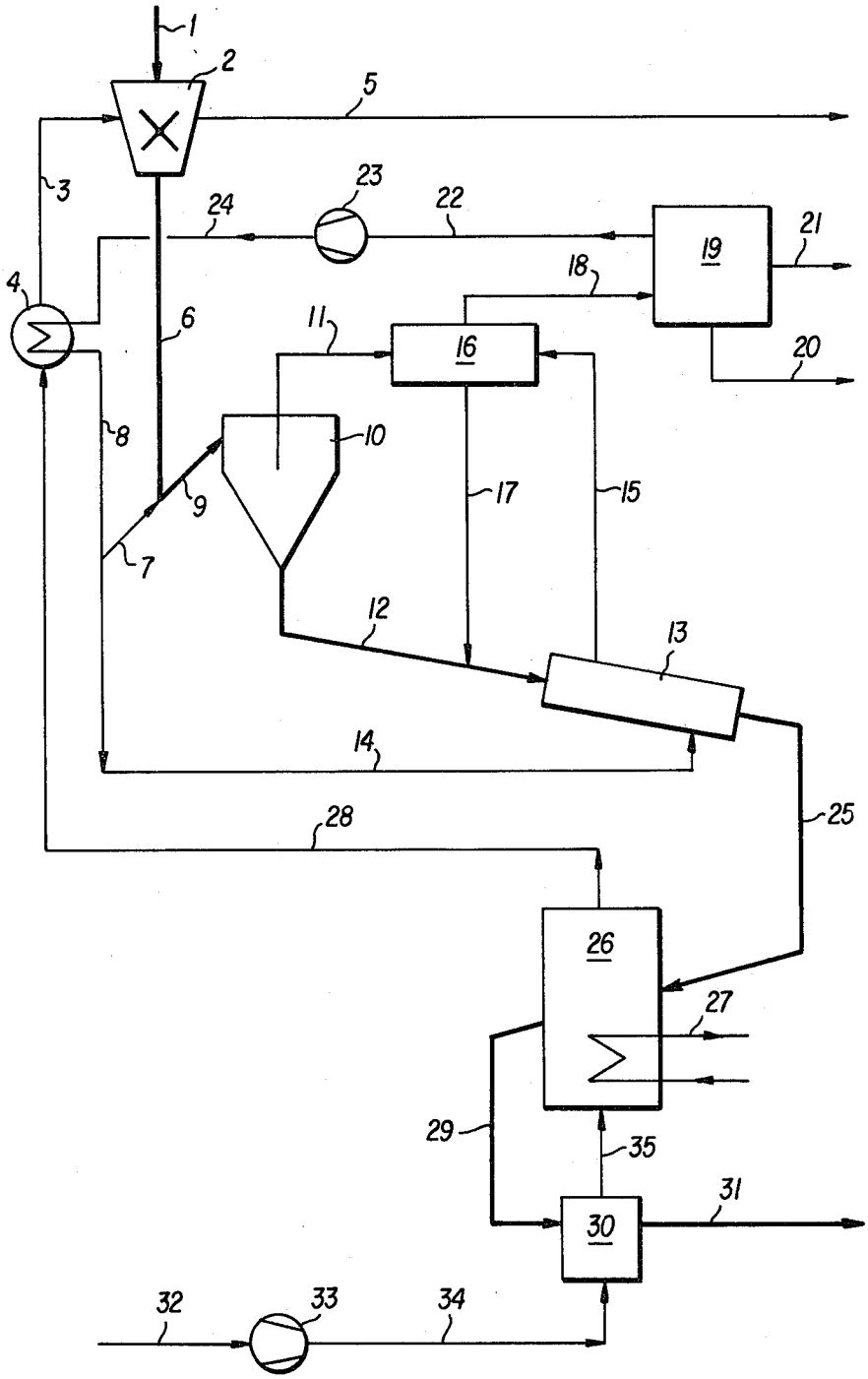
FIG. 3 shows a schematic representation of an apparatus according to the invention.

FIG. 3 shows a schematic representation of an apparatus according to the invention. The method according to the invention will now be explained in reference to this figure.

The oil shale 1 is crushed to a granular size smaller than 3 mm. Crushing and sifting occur advantageously together with the drying and pre-heating in a drying grinder 2 that makes use of the flue gases 3 leaving the circulation gas pre-heater 4. The cooled flue gas is removed through pipe 5.

The oil shale 6, crushed, dried and pre-heated to ca. 110° C. is mixed in the riser 7 with circulating distillation gas 8, with a considerable portion of the heat from the heating gas already passing to the shale in the riser, and this mixture is taken through the tangential feeder 9 into the distillation cyclone 10. Distillation gases containing oil and dust leave the distillation cyclone 10 through conduit 11, while the distillation residue is taken through conduit 12 into a degassing drum 13. To accelerate the removal of generating distillation gases, a portion of the hot circulation gas is taken through conduit 14 into the rotating degassing drum 13. The distillation and circulating gas 15 from the degassing drum 13 is taken from the distillation cyclone with the distillation gases 11 into a dust removal system 16. The separated dust is taken to the degassing drum 13 through conduit 17. The gas, having been cleaned of dust, passes through pipe line 18 into the oil separator 19 and there is condensible components are removed as product through conduit 20 for further processing. A portion of the distillation gas, corresponding to the amount of gas generated during the distillation, is also removed as product from the oil separator 19 through conduit 21. The remaining distillation gas is taken through conduit 22 to the condenser 23 including a blower and after condensation through conduit 24 to the circulating gas pre-heater 4.

The hot distillation residue 25 behind the degassing drum 13 is taken to a fluid bed combustion furnace 26 where the residual carbon is burnt off. The temperature adjustment for optimal $SO_2$ bonding is accomplished through the heat exchanger 27 in the fluid bed, which is constructed as a steam generator. The hot flue gas leaves the fluid bed furnace through conduit 28. The heat content of this gas is used in the circulation gas heat exchanger 4 for the distillation and in the drying grinder 2 to dry and pre-heat the oil shale.

The burnt oil shale is taken from the fluid bed furnace through conduit 29 to a cooler 30 and leaves the cooler through conduit 31. The combustion air 32, which is compressed in the compressor 33, is used for cooling and is taken through conduit 34, to the cooler 30, and through conduit 35 into the fluid bed furnace 26.

The invention now being fully described, it will be apparent to one of ordinary skill in the art that many changes and modifications can be made thereto without departing from the spirit or scope of the invention as set forth herein.

What is claimed as new and desired to be secured by Letters Patent of the United States is:

1. A method for the distillation of oil shale in a distillation cyclone reaction using a hot gas to heat said oil shale comprising:

utilizing distillation gas as said hot gas after separation of the condensable portion of said distillation gas;

removing a portion of said hot gas corresponding to the increase in the amount of gas generated by distillation, tangentially introducing said stream of oil shale and hot gas, in combination, into said distillation cyclone reactor; and re-heating the residual portion of said hot gas without adding solid material.

2. The method according to claim 1, wherein said oil shale is pre-heated to a temperature below the temperature at which kerogen in said oil shale decomposes and dried before said oil shale is contacted with said hot gas.

3. The method according to claim 1, wherein oil shale with a granular size of up to 5 mm is subjected to distillation.

4. The method according to claim 1, wherein dust is removed from said distillation gas at a temperature above the dew point of the condensible portion of said distillation gas.

5. The method according to claim 4, wherein said dust is removed by electrostatic precipitation.

6. The method according to claim 1, wherein carbon in a distillation residue is burned with oxygen or a gas mixture containing oxygen to give a combustion gas, and wherein said combustion gas is used to heat said hot gas before said hot gas contacts said oil shale.

7. The method according to claim 6, wherein said combustion gas is used to heat and dry said oil shale after heating said hot gas.

8. The method of claim 6, wherein said distillation residue is held in a container at the distillation temperature after being removed from said distillation cyclone reactor.

9. The method according to claim 8, wherein distillation gas, after removal of condensible portions, is passed through the distillation residue being agitated by stirring or by means of a rotating drum.

10. An apparatus for the distillation of oil shale, comprising:

a distillation cyclone reactor including tangential solid material and gas feed nozzle means, gas introducing means and solid introducing means connected with said gas feed nozzle means, and also including gas discharge means;

separator means connected to said reactor gas discharge means for separating condensable portions of the gas discharged from said reactor, and including means for discharging the uncondensed separated gas;

blower means connected to said gas discharge means of said separator means;

heat exchanger means connected to said blower means for heating the separated gas from said blower means; and communicating means connected between said heat exchanger and said reactor feed nozzle means for communicating the heated separated gas to said reactor feed nozzle means, whereby the distillation reactor discharge gas is recirculated to said reactor.

11. The apparatus of claim 10 including an oil shale preheater connected to said communicating means.

12. The apparatus of claim 10 or 11 including a dust remover connected between said reactor and said separator means.

13. The apparatus of claim 12 wherein said dust remover is an electrostatic precipitator.

14. The apparatus of claim 10 or 11 including means for discharging solid material from said reactor and combustion furnace means connected to said means for discharging solid material from said reactor.

15. The apparatus of claim 14 including a rotating degassing drum connected between said reactor and said furnace for degassing of the solid material discharged through said means for discharging solid material.

16. The apparatus of claim 14 including means connecting combustion gas from said furnace to said heat exchanger for heating said separated gas.

* * * * *